US007701146B2

(12) United States Patent
Kong et al.

(10) Patent No.: US 7,701,146 B2
(45) Date of Patent: Apr. 20, 2010

(54) PLASMA DISPLAY APPARATUS

(75) Inventors: Byung Goo Kong, Seoul (KR); Jeong Pil Choi, Gyeonggi-do (KR)

(73) Assignee: LG Electronics Inc., Seoul (KR)

( * ) Notice: Subject to any disclaimer, the term of this patent is extended or adjusted under 35 U.S.C. 154(b) by 381 days.

(21) Appl. No.: 11/300,453

(22) Filed: Dec. 15, 2005

(65) Prior Publication Data

US 2006/0132392 A1 Jun. 22, 2006

(30) Foreign Application Priority Data

Dec. 16, 2004 (KR) ..... 10-2004-0106913

(51) Int. Cl.
*G09G 3/10* (2006.01)

(52) U.S. Cl. ..... 315/169.4

(58) Field of Classification Search ..... 315/169.4; 345/60, 63, 66, 67, 68, 69, 70
See application file for complete search history.

(56) References Cited

U.S. PATENT DOCUMENTS 5,786,794 A * 7/1998 Kishi et al. ..... 345/60
6,850,213 B2 * 2/2005 Marcotte ..... 345/60
2004/0207332 A1 * 10/2004 Cho et al. ..... 315/169.4

FOREIGN PATENT DOCUMENTS

| | | | |
|---|---|---|---|
| EP | 1310936 | A1 | 5/2003 |
| JP | 2001-331147 | A | 11/2001 |
| KR | 10-2005-0082627 | A | 8/2005 |

* cited by examiner

*Primary Examiner*—Douglas W Owens
*Assistant Examiner*—Jianzi Chen
(74) *Attorney, Agent, or Firm*—Birch, Stewart, Kolasch & Birch, LLP

(57) ABSTRACT

Provided is a plasma display apparatus. The apparatus comprises: a plasma display panel; an energy storing unit supplying or recovering energy; an energy supply controller forming a path for supplying the energy from the energy storing unit; a first resonance unit supplying the energy supplied from the energy supply controller, to the plasma display panel through resonance; a second resonance unit forming the resonance together with the first resonance unit, and recovering the energy from the plasma display panel to the energy storing unit; and an energy recovery controller positioned between the first resonance unit and the second resonance unit, and forming a path for recovering the energy.

7 Claims, 5 Drawing Sheets

*-PRIOR ART-*

*-PRIOR ART-*

*-PRIOR ART-*

PLASMA DISPLAY APPARATUS

This Nonprovisional application claims priority under 35 U.S.C. §119(a) on Patent Application No. 2004-106913 filed in Korea on Dec. 16, 2004, the entire contents of which are hereby incorporated by reference.

BACKGROUND OF THE INVENTION

1. Field of the Invention

The present document relates to a plasma display apparatus.

2. Description of the Background Art

FIG. 1 illustrates a structure of a conventional plasma display panel. As shown in FIG. 1, the conventional plasma display panel is comprised of a front panel 100 and a rear panel 110. The front panel 100 comprises a rear glass substrate 101, and the rear panel 110 comprises a rear glass substrate 111. The front panel 100 and the rear panel 110 are sealed in parallel to be at a predetermined distance.

Sustain electrode pairs 102 and 103 for sustaining light emission of the cell by a mutual discharge are formed on the front glass substrate 101. The sustain electrode pairs 102 and 103 are comprised of a scan electrode 102 and a sustain electrode 103. The scan electrode 102 and the sustain electrode 103 each are transparent electrodes 102-*a* and 103-*a* formed of transparent indium tin oxide (ITO) and bus electrodes 102-*b* and 103-*b* formed of metal. The scan electrode 102 receives a scan signal for panel scan, and a sustain signal for discharge sustain. The sustain electrode 103 mainly receives a sustain signal. An upper dielectric layer 104 is formed on the sustain electrodes 102 and 103, and limits a discharge current and insulates between the scan electrode 102 and the sustain electrode 103. A protective layer 105 is formed on an upper surface of the upper dielectric layer 104, and is formed of magnesium oxide (MgO) to facilitate a discharge condition.

An address electrode 113 is disposed to intersect with the sustain electrode pairs 102 and 103 on the rear glass substrate 111. A lower dielectric layer 115 is formed on the address electrode 113, and insulates between the address electrodes 13. A barrier rib 112 is formed on the lower dielectric layer 115, and partitions a discharge cell. Red (R), green (G), and blue (B) phosphor layers 114 are coated between the barrier ribs 112, and emit visible rays for displaying an image.

The front panel 100 and the rear panel 110 are coalesced by a sealing material. After the coalescing of the front panel 100 and the rear panel 110, inert gas such as helium (He), neon (Ne), and xenon (Xe) is injected into the plasma display panel.

In the above-constructed conventional plasma display panel, one frame is divided into several subfields to embody an image, and each subfield is divided into a reset period, an address period, and a sustain period.

Meantime, a plasma display apparatus comprises the plasma display panel and a driving device. The driving device comprises a sustain driving circuit for applying an alternating sustain pulse to a scan electrode and a sustain electrode to sustain a discharge of a discharge cell selected in the sustain period.

FIG. 2 illustrates an energy recovery circuit comprised in the conventional plasma display apparatus, and FIG. 3 is a waveform diagram illustrating the sustain pulse of the conventional energy recovery circuit.

A first switch (Q1) turns on and, a second switch (Q2), a third switch (Q3), and a fourth switch (Q4) turn off. Accordingly, energy is supplied from a capacitor (C1) to a plasma display panel (Cp) through resonance. As shown in FIG. 3, a voltage of electrode (Vp) rises from a ground level to a sustain voltage (Vs). The sustain voltage (Vs) is a voltage for sustaining the discharge in the discharge cell selected during the address period.

The third switch (Q3) turns on and, the first switch (Q1), the second switch (Q2), and the fourth switch (Q4) turn off. Accordingly, as shown in FIG. 3, the voltage of electrode (Vp) is sustained to be the sustain voltage (Vs).

The second switch (Q2) turns on and, the first switch (Q1), the third switch (Q3), and the fourth switch (Q4) turn off. Accordingly, energy is supplied from the plasma display panel (Cp) to the capacitor (C1) through the resonance. As shown in FIG. 3, the voltage of electrode (Vp) falls from the sustain voltage (Vs) to the ground level.

The fourth switch (Q4) turns on and, the first switch (Q1), the second switch (Q2), and the third switch (Q3) turn off. Accordingly, as shown in FIG. 3, the voltage of electrode (Vp) is sustained to be the ground level voltage.

In the conventional energy recovery circuit, one inductor (L1) is used for recovering and supplying the energy. In other words, if the inductor (L1) has a great inductance, consumption power reduces and therefore, a driving efficiency of the energy recovery circuit increases but a voltage rise of the sustain pulse is gentle, thereby making it difficult to generate a strong discharge.

SUMMARY OF THE INVENTION

Accordingly, an object of the present invention is to solve at least the problems and disadvantages of the background art.

An object of the present invention is to provide a plasma display apparatus and a driving device of a plasma display panel, for enhancing an efficiency of energy recovery and promoting a voltage rise of a sustain pulse.

To achieve these and other advantages and in accordance with the purpose of the present invention, as embodied and broadly described, there is provided a plasma display apparatus comprising: a plasma display panel; an energy storing unit supplying or recovering energy; an energy supply controller forming a path for supplying the energy from the energy storing unit; a first resonance unit supplying the energy supplied from the energy supply controller, to the plasma display panel through resonance; a second resonance unit forming the resonance together with the first resonance unit, and recovering the energy from the plasma display panel to the energy storing unit; and an energy recovery controller positioned between the first resonance unit and the second resonance unit, and forming a path for recovering the energy.

In another aspect of the present invention, there is provided a driving device of a plasma display panel comprising: an energy storing unit supplying or recovering energy; an energy supply controller forming a path for supplying the energy from the energy storing unit; a first resonance unit supplying the energy supplied from the energy supply controller, to the plasma display panel through resonance; a second resonance unit forming the resonance together with the first resonance unit, and recovering the energy from the plasma display panel to the energy storing unit; and an energy recovery controller positioned between the first resonance unit and the second resonance unit, and forming a path for recovering the energy.

In a further another aspect of the present invention, there is provided a plasma display apparatus comprising: a plasma display panel; an energy storing unit supplying or recovering energy; an energy supply controller connected to the energy storing unit, and forming a path for supplying the energy from the energy storing unit; a first resonance unit connected to the energy supply controller, and supplying the energy supplied from the energy supply controller, to the plasma display panel through resonance; an energy recovery controller connected to the first resonance unit, and forming a path for recovering the energy from the plasma display panel; and a second resonance unit connected to the energy recovery controller, and forming the resonance together with the first resonance unit when the energy is recovered.

In an embodiment of the present invention, when the energy is supplied and recovered, the inductances are different, thereby enhancing a driving efficiency and generating a strong discharge.

In an embodiment of the present invention, the inductors are spaced apart, thereby preventing reduction of the driving efficiency.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Figure 1:
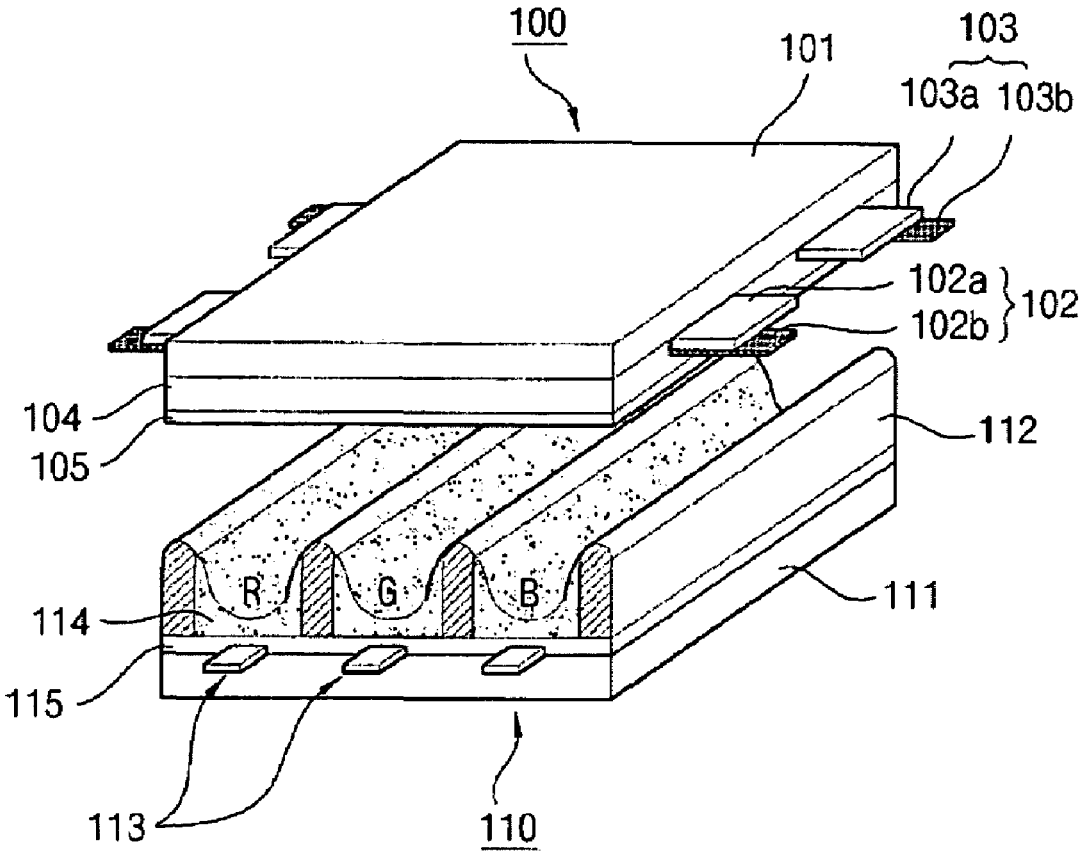
FIG. 1 illustrates a structure of a conventional plasma display panel.
Figure 2:
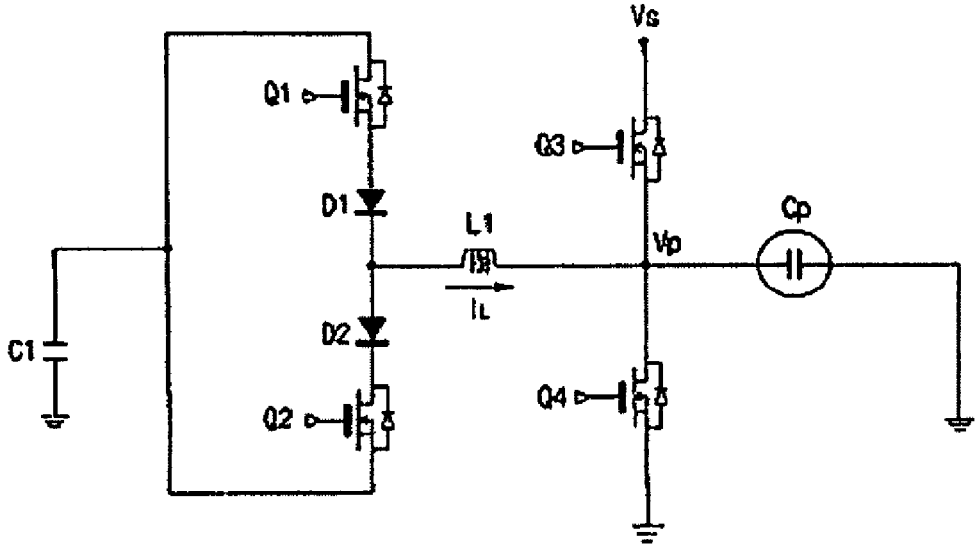
FIG. 2 illustrates an energy recovery circuit comprised in a conventional plasma display apparatus.
Figure 3:
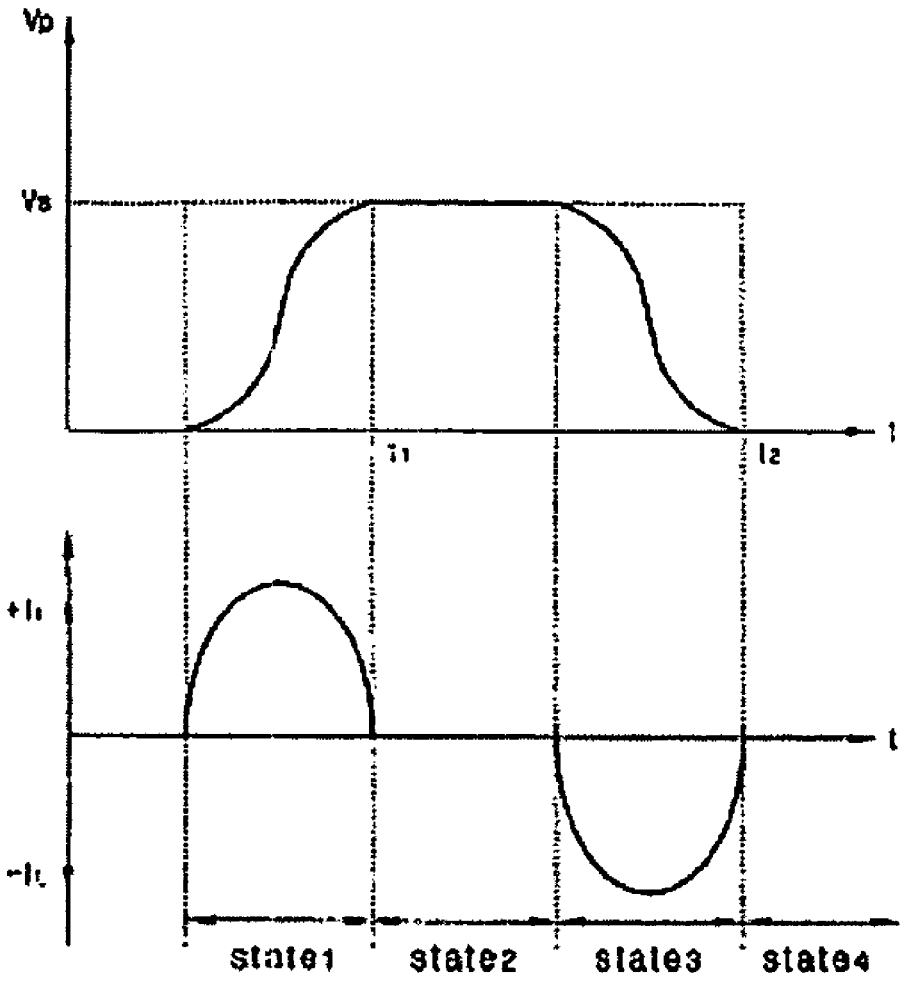
FIG. 3 is a waveform diagram illustrating a sustain pulse of a conventional energy recovery circuit.

Preferred embodiments of the present invention will be described in a more detailed manner with reference to the drawings.

In one aspect of the present invention, there is provided a plasma display apparatus comprising: a plasma display panel; an energy storing unit supplying or recovering energy; an energy supply controller forming a path for supplying the energy from the energy storing unit; a first resonance unit supplying the energy supplied from the energy supply controller, to the plasma display panel through resonance; a second resonance unit forming the resonance together with the first resonance unit, and recovering the energy from the plasma display panel to the energy storing unit; and an energy recovery controller positioned between the first resonance unit and the second resonance unit, and forming a path for recovering the energy.

The apparatus further may comprise a first voltage source unit sustaining a voltage of electrode of the plasma display panel to be a first voltage after the energy is supplied to the plasma display panel.

The first voltage may be a sustain voltage for sustaining a sustain discharge.

The apparatus further may comprise a second voltage source unit sustaining a voltage of electrode of the plasma display panel to be a second voltage after the energy is recovered from the plasma display panel.

The second voltage may be a ground level voltage.

The inductance of the first resonance unit may be the same as the inductance of the second resonance unit.

The energy supply controller may comprise a first switch for forming the path for supplying the stored energy from the energy storing unit to the plasma display panel and a first diode for cutting off a reverse current flowing to the first switch, and the first resonance unit may comprise a first inductor forming the resonance when the energy is supplied, and the energy supply controller may comprise a second switch for forming the path for recovering the energy to the energy storing unit and a second diode for cutting off a reverse current flowing to the second switch, and the second resonance unit may comprise a second inductor forming the resonance together with the first inductor when the energy is recovered.

One terminal of the first inductor may be commonly connected to a cathode of the first diode and an anode of the second diode, and the other terminal of the first inductor may be connected to an electrode of the plasma display panel, and wherein one terminal of the second inductor may be connected to the second switch, and the other terminal may be connected to the energy storing unit.

In another aspect of the present invention, there is provided a driving device of a plasma display panel comprisses an energy storing unit supplying or recovering energy, an energy supply controller forming a path for supplying the energy from the energy storing unit, a first resonance unit supplying the energy supplied from the energy supply controller, to the plasma display panel through resonance, a second resonance unit forming the resonance together with the first resonance unit, and recovering the energy from the plasma display panel to the energy storing unit, and an energy recovery controller positioned between the first resonance unit and the second resonance unit, and forming a path for recovering the energy.

The device may further comprise a first voltage source unit sustaining a voltage of electrode of the plasma display panel to be a first voltage after the energy is supplied to the plasma display panel.

The first voltage may be a sustain voltage for sustaining a sustain discharge.

The device may further comprise a second voltage source unit sustaining a voltage of electrode of the plasma display panel to be a second voltage after the energy is recovered from the plasma display panel.

The second voltage may be a ground level voltage.

The inductance of the first resonance unit may be the same as the inductance of the second resonance unit.

The energy supply controller may be comprise a first switch for forming the path for supplying the stored energy from the energy storing unit to the plasma display panel and a first diode for cutting off a reverse current flowing to the first switch, and the first resonance unit may comprise a first inductor forming the resonance when the energy is supplied, and the energy supply controller may comprise a second switch for forming the path for recovering the energy to the energy storing unit and a second diode for cutting off a reverse current flowing to the second switch, and the second resonance unit may comprise a second inductor forming the resonance together with the first inductor when the energy is recovered.

One terminal of the first inductor may be commonly connected to a cathode of the first diode and an anode of the second diode, and the other terminal of the first inductor may be connected to an electrode of the plasma display panel, and wherein one terminal of the second inductor may be connected to the second switch, and the other terminal may be connected to the energy storing unit.

In a further another aspect of the present invention, there is provided a plasma display apparatus comprises a plasma display panel, an energy storing unit supplying or recovering energy, an energy supply controller connected to the energy storing unit, and forming a path for supplying the energy from the energy storing unit, a first resonance unit connected to the energy supply controller, and supplying the energy supplied from the energy supply controller, to the plasma display panel through resonance; an energy recovery controller connected to the first resonance unit, and forming a path for recovering the energy from the plasma display panel, and a second resonance unit connected to the energy recovery controller, and forming the resonance together with the first resonance unit when the energy is recovered.

The apparatus may further comprise a first voltage source unit sustaining a voltage of electrode of the plasma display panel to be a first voltage after the energy is supplied to the plasma display panel.

The apparatus may further comprise a second voltage source unit sustaining a voltage of electrode of the plasma display panel to be a second voltage after the energy is recovered from the plasma display panel.

Hereinafter, an embodiment of the present invention will be in detail described with reference to attached drawings.

Figure 4:
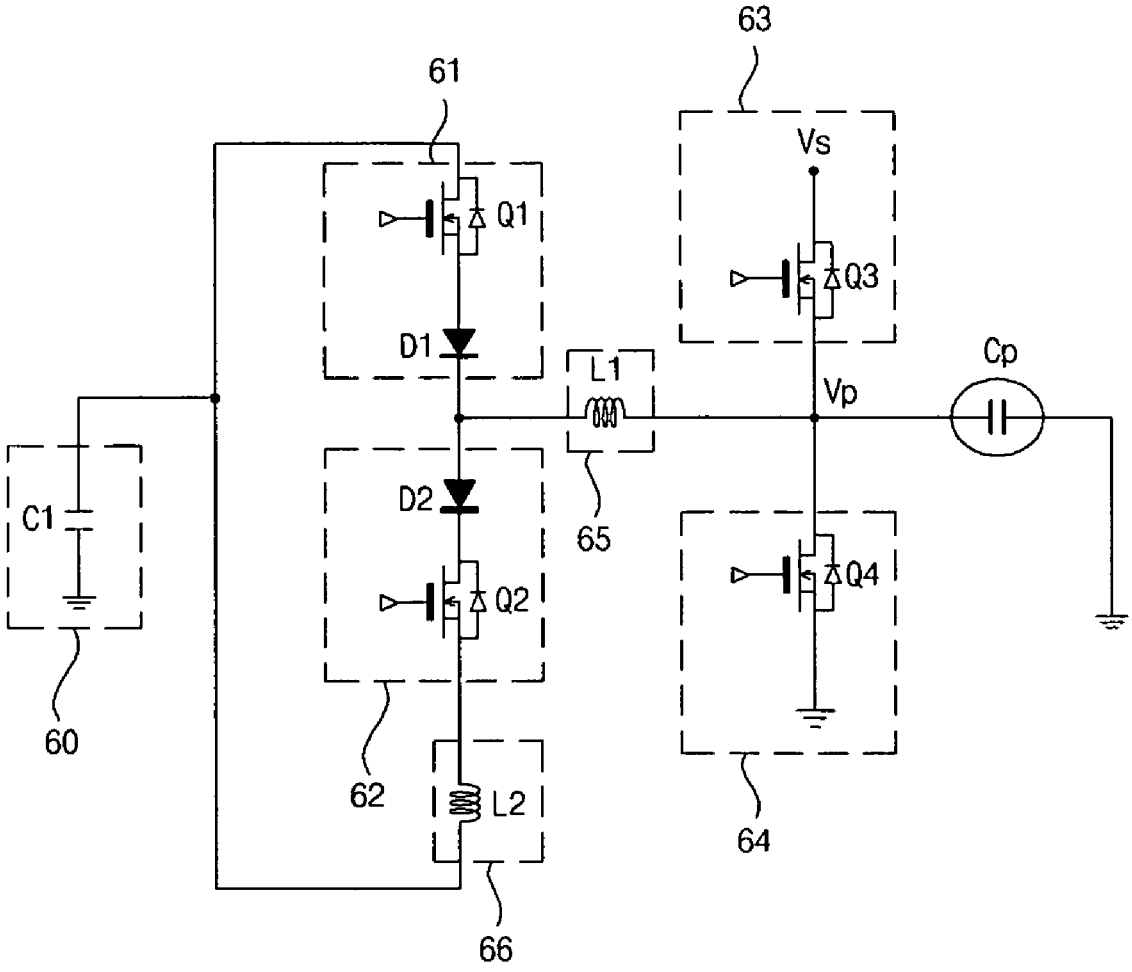
FIG. 4 illustrates a plasma display apparatus according to an embodiment of the present invention.

FIG. 4 illustrates a plasma display apparatus according to an embodiment of the present invention. As shown in FIG. 4, an energy recovery circuit according to the present invention comprises an energy storing unit 60, an energy supply controller 61, a first resonance unit 65, a first voltage source unit 63, an energy recovery controller 62, a second resonance unit 66, and a second voltage source unit 64.

<Energy Storing Unit>

The energy storing unit 60 comprises an energy recovery capacitor (C1) for storing energy corresponding to a first voltage supplied or recovered. The first voltage is a half of a sustain voltage. The sustain voltage is a voltage required for sustaining a discharge in a cell selected in an address period.

<Energy Supply Controller>

The energy supply controller 61 forms a path for supplying the energy from the energy storing unit 60. The energy supply controller 61 comprises a first switch (Q1) and a first diode (D1). The first switch (Q1) turns on, thereby forming a path for supplying the stored energy from the energy recovery capacitor (C1) of the energy storing unit 60 to a plasma display panel (Cp). The first diode (D1) cuts off a reverse current flowing from the plasma display panel (Cp) to the first switch (Q1) when the first switch (Q1) turns on. One terminal of the first switch (Q1) is connected to one terminal of the energy recovery capacitor (C1), and the other terminal of the energy recovery capacitor (C1) is connected to the other terminal of the first diode (D1). A cathode of the first diode is connected to one terminal of the first inductor (L1).

<First Resonance Unit>

The first resonance unit 65 forms the resonance with the plasma display panel (Cp) when the energy is supplied to the plasma display panel (Cp) through the first switch (Q1) of the energy supply controller 61. Accordingly, when the energy is supplied through the energy supply controller 61, the plasma display panel (Cp) is charged up to the sustain voltage with the energy supplied via a first inductor (L1). The first resonance unit 65 comprises the first inductor (L1). One terminal of The first inductor (L1) is connected to the cathode of the first diode (D1).

<First Voltage Source Unit>

After the plasma display panel (Cp) is charged up to the sustain voltage, the first voltage source unit 63 sustains a voltage of electrode (Vp) of the plasma display panel (Cp) to be the sustain voltage. The first voltage source unit 63 comprises a sustain voltage source (Vs) for supplying the sustain voltage, and a third switch (Q3) When the plasma display panel (Cp) is charged up to the sustain voltage, the third switch (Q3) turns on, thereby sustaining the voltage of electrode of the plasma display panel (Cp) to be the sustain voltage (Vs). One terminal of the third switch (Q3) is connected to the sustain voltage source (Vs), and the other terminal of the third switch (Q3) is commonly connected to the other terminal of the first inductor (L1) and an electrode of the plasma display panel (Cp).

<Energy Recovery Controller>

The energy recovery controller 62 forms a path for recovering energy from the plasma display panel (Cp) to the energy storing unit 60. The energy recovery controller 62 comprises a second switch (Q2) and a second diode (D2). The second switch (Q2) turns on, thereby forming a path for recovering the stored energy from the plasma display panel (Cp) to the energy recovery capacitor (C1) of the energy storing unit 60. The second diode (D2) cuts off a reverse current flowing from the energy recovery capacitor (C1) to the second switch (Q2) when the second switch (Q2) turns on. An anode of the second diode (D2) is commonly connected to one terminal of the first inductor (L1) and a cathode of the first diode (D1), and a cathode of the second diode (D2) is connected to one terminal of the second switch (Q2).

<Second Resonance Unit>

The second resonance unit 66 forms the resonance together with the plasma display panel (Cp) and the first resonance unit 65 when the energy is recovered from the plasma display panel (Cp) through the second switch (Q2) of the energy recovery controller 62. Accordingly, when the energy is recovered through the energy recovery controller 62, the plasma display panel (Cp) is charged up to a ground level voltage with the energy recovered via the first resonance unit 65 and the second resonance unit 66. The second resonance unit 66 comprises a second inductor (L2) One terminal of the second inductor (L2) is connected to the other terminal of the second switch (Q2), and the other terminal of the second inductor (L2) is connected to one terminal of the energy recovery capacitor (C1). The inductance of the second inductor (L2) can be the same as the inductance of the first inductor (L1). The inductance of the second inductor (L2) can be different from the inductance of the first inductor (L1).

<Second Voltage Source Unit>

After the plasma display panel (Cp) is charged up to the ground level voltage, the second voltage source unit 64 sustains the voltage of electrode (Vp) of the plasma display panel (Cp) to be the ground level voltage. The second voltage source unit 64 comprises a fourth switch (Q4). When the plasma display panel (Cp) is charged up to the ground level voltage, the fourth switch (Q4) turns on, thereby sustaining the voltage of electrode (Vp) of the plasma display panel (Cp) to be the ground level voltage. One terminal of the fourth switch (Q4) is commonly connected to the other terminal of the first inductor (L1) and the electrode of the plasma display panel (Cp), and the other terminal of the fourth switch (Q4) is grounded.

An operation of the plasma display apparatus according to an embodiment of the present invention will be in detail described with reference to FIG. 5.

Figure 5:
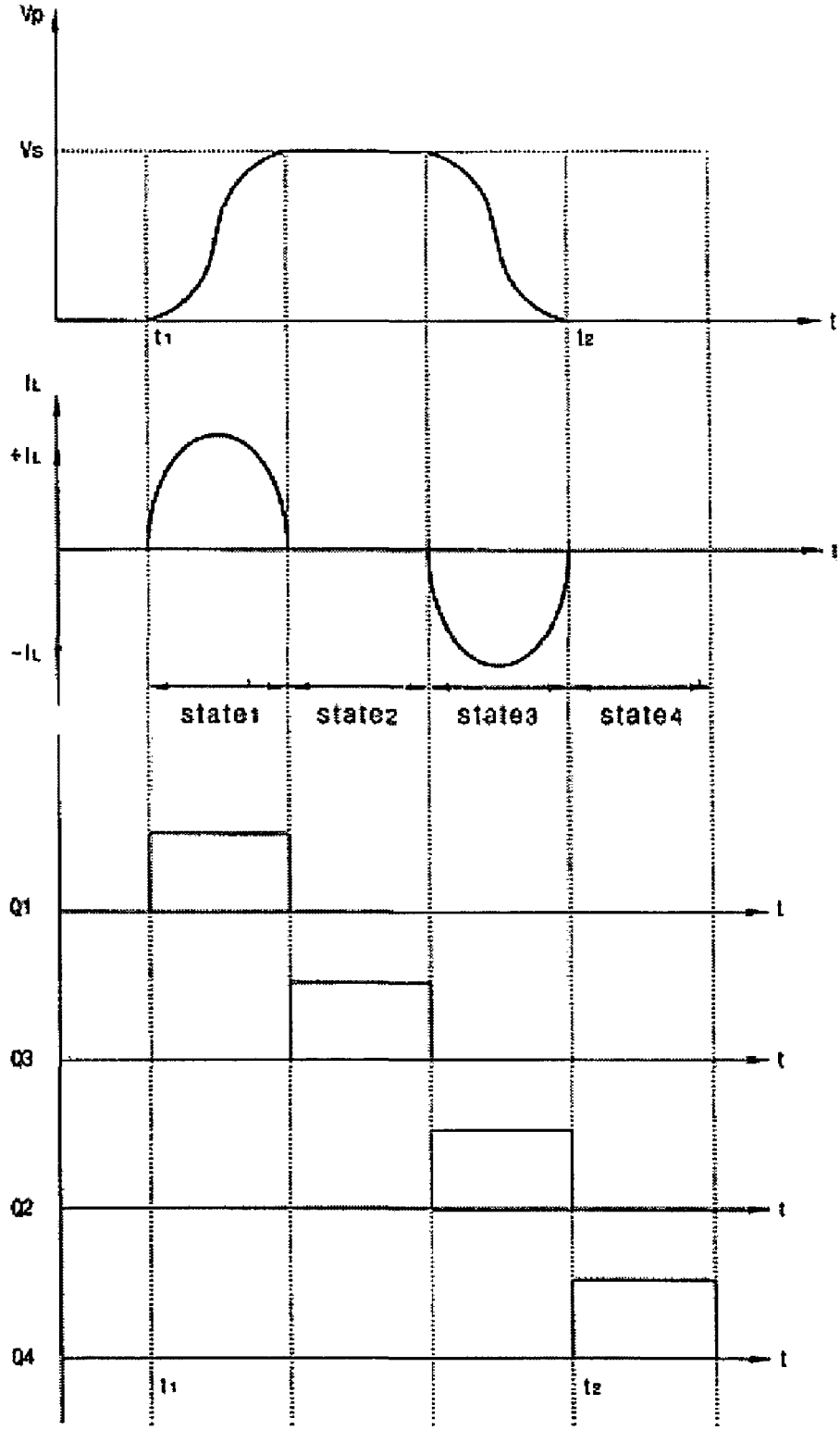
FIG. 5 is a diagram illustrating a switching timing, and a voltage waveform and a current waveform depending on switching, for an operation of a plasma display apparatus according to an embodiment of the present invention.

FIG. 5 is a diagram illustrating a switching timing, and a voltage waveform and a current waveform depending on switching, for the operation of the plasma display apparatus according to an embodiment of the present invention.

In a first state (state 1), the first switch (Q1) turns on and, the second switch (Q2), the third switch (Q3), and the fourth switch (Q4) all turn off. Accordingly, the energy stored in the energy recovery capacitor (C1) is supplied to the plasma display panel (Cp). The energy supplying path is comprised of the energy recovery capacitor (C1), the first switch (Q1), the first diode (D1), the first inductor (L1), and the plasma display panel (Cp).

When the first switch (Q1) turns on, the second resonance unit 66 is in a floating state, and current flowing through the first inductor (L1) forms a magnetic field. The first inductor (L1) is spaced apart from the second inductor (L2) by the energy recovery controller 62 and therefore, the magnetic field formed by the current flowing through the first inductor (L1) is not easy to have influence on the second inductor (L2). Accordingly, an interaction between the first inductor (L1) and the second inductor (L2) reduces.

If the interaction between the first inductor (L1) and the second inductor (L2) is great, the second inductor (L2) being in the floating state causes unnecessary resonance and therefore, unnecessary energy more than suitable energy for a sustain discharge is supplied to the plasma display panel (Cp).

However, the first resonance unit 65 comprised in the plasma display apparatus according to an embodiment of the invention is spaced apart from the second inductor (L2) by the energy recovery controller 62 and therefore, the interaction between the first inductor (L1) and the second inductor (L2) reduces, thereby preventing a driving efficiency from reducing due to the unnecessary resonance.

In a second state (state 2), the third switch (Q3) turns on and, the first switch (Q1), the second switch (Q2), and the fourth switch (Q4) turn off. Accordingly, the voltage of electrode (Vp) of the plasma display panel (Cp) is sustained to be the sustain voltage.

In a third state (state 3), the second switch (Q2) turns on and, the first switch (Q1), the third switch (Q3), and the fourth switch (Q4) all turn off. Accordingly, the stored energy is recovered from the plasma display panel (Cp) to the energy recovery capacitor (C1). The energy recovering path is comprised of the plasma display panel (Cp), the first inductor (L1), the second diode (D2), the second switch (Q2), the second inductor (L2), and the energy recovery capacitor (C1).

In the first state (state 1), the resonance is formed between the first inductor (L1) and the plasma display panel (Cp) and, in the third state (state 3), the resonance is formed between the first and second inductors (L1 and L2) and the plasma display panel (Cp). Accordingly, when the energy is supplied to the plasma display panel (Cp), the resonance is formed by the inductance of the first inductor (L1), and when the energy is recovered from the plasma display panel (Cp), the resonance is formed by a sum of the inductance of the first inductor (L1) and the inductance of the second inductor (L2). Accordingly, the inductance when the energy is supplied is less than the inductance when the energy is recovered. Therefore, the voltage rise of the sustain pulse is promoted. Further, the inductance when the energy is recovered is larger. Therefore, consumption power is reduced, and the efficiency when the energy is recovered is improved.

Meantime, when the second switch (Q2) turns on, the first resonance unit 65 is in the floating state, and the current flowing through the second inductor (L2) forms the magnetic field. The second inductor (L2) is spaced apart from the first inductor (L1) by the energy supply controller 61 and therefore, the magnetic field formed by the current flowing through the second inductor (L2) is not easy to have influence on the first inductor (L1). Accordingly, the interaction between the first inductor (L1) and the second inductor (L2) reduces.

If the interaction between the first inductor (L1) and the second inductor (L2) is great, the first inductor (L1) being in the floating state causes unnecessary resonance. Therefore, greater energy than necessary energy is recovered from the plasma display panel (Cp).

However, the second resonance unit 66 comprised in the inventive plasma display apparatus is spaced apart from the second inductor (L2) by the energy recovery controller 62. Therefore, the interaction between the first inductor (L1) and the second inductor (L2) reduces, thereby preventing the driving efficiency from reducing due to the unnecessary resonance.

In a fourth state (state 4), the fourth switch (Q4) turns on and, the first switch (Q1), the second switch (Q2), and the third switch (Q3) turn off. Accordingly, the voltage applied to the plasma display panel (Cp) is at a ground level.

As described above, in the present invention, spatial arrangement between the resonance units is controlled, thereby reducing various interactions comprising influence of the magnetic field between the resonance units, and suppressing reduction of the driving efficiency of the driving device of the plasma display panel even without providing an additional part such as a clamp diode.

The invention being thus described, it will be obvious that the same may be varied in many ways. Such variations are not to be regarded as a departure from the spirit and scope of the invention, and all such modifications as would be obvious to one skilled in the art are intended to be comprised within the scope of the following claims.

What is claimed is:

1. A plasma display apparatus, comprising:

a plasma display panel;

an energy storing unit supplying or recovering energy;

an energy supply controller connected to the energy storing unit, and forming a path for supplying the energy from the energy storing unit;

a first resonance unit having an input directly connected to an output of the energy supply controller, and configured to supply the energy supplied from the energy supply controller to the plasma display panel through resonance;

an energy recovery controller having a first terminal directly connected to the input of the first resonance unit, and arranged to form a path for recovering the energy from the plasma display panel; and a second resonance unit directly connected to a second terminal of the energy recovery controller, and configured to form the resonance together with the first resonance unit when the energy is recovered.

2. The apparatus of claim 1, further comprising:

a first voltage source unit sustaining a voltage of electrode of the plasma display panel to be a first voltage after the energy is supplied to the plasma display panel.

3. The apparatus of claim 1, further comprising:

a second voltage source unit sustaining a voltage of electrode of the plasma display panel to be a second voltage after the energy is recovered from the plasma display panel.

4. The apparatus of claim 3, wherein the second voltage is a ground level voltage.

5. The apparatus of claim 1, wherein an inductance of the first resonance unit is the same as an inductance of the second resonance unit.

6. The apparatus of claim 1, wherein the energy supply controller comprises:

a first switch forming the path for supplying the energy from the energy storing unit to the plasma display panel, and a first diode configured to cut off a reverse current flowing to the first switch, wherein the first resonance unit comprises a first inductor forming the resonance when the energy is supplied, wherein the energy recovery controller comprises:

a second switch forming the path for recovering the energy to the energy storing unit, and a second diode configured to cut off a reverse current flowing to the second switch, and wherein the second resonance unit comprises a second inductor forming the resonance together with the first inductor when the energy is recovered.

7. The apparatus of claim 6, wherein one terminal of the first inductor is directly connected to a cathode of the first diode and an anode of the second diode, and the other terminal of the first inductor is connected to an electrode of the plasma display panel, and wherein one terminal of the second inductor is directly connected to the second switch, and the other terminal is directly connected to the energy storing unit.

* * * * *